US010589910B2

(12) United States Patent
Lavelock

(10) Patent No.: US 10,589,910 B2
(45) Date of Patent: Mar. 17, 2020

(54) CONTAINER WITH EXPIRATION DATE ALARM

(71) Applicant: HONEYWELL FEDERAL MANUFACTURING & TECHNOLOGIES, LLC, Kansas City, MO (US)

(72) Inventor: Rick L. Lavelock, Pleasant Hill, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 124 days.

(21) Appl. No.: 14/963,024

(22) Filed: Dec. 8, 2015

(65) Prior Publication Data

US 2017/0158389 A1 Jun. 8, 2017

(51) Int. Cl.
*B65D 51/24* (2006.01)

(52) U.S. Cl.
CPC ..... *B65D 51/248* (2013.01)

(58) Field of Classification Search
CPC .. B65D 51/248; B65D 81/3802; B65D 45/34; B65D 45/345; G08B 21/24; A61J 7/0436; A61J 7/0472; A61J 2205/70; G06F 19/3418; C23C 28/32; C23F 1/02; G06Q 10/087; H01B 1/02; G04F 1/005; A61L 2209/111; A63F 2009/2447
USPC ..... 220/321; 340/309.16–309.9, 545.6
See application file for complete search history.

(56) References Cited

U.S. PATENT DOCUMENTS

| | | | | |
|---|---|---|---|---|
| 6,084,504 | A | 7/2000 | Rosche | |
| 6,104,307 | A | 8/2000 | Hanratty | |
| 6,542,078 | B2 * | 4/2003 | Script | G08B 13/08 340/539.1 |
| 6,622,925 | B2 * | 9/2003 | Carner | G05D 23/1905 165/209 |
| 7,532,544 | B2 * | 5/2009 | Morse | A61J 7/0472 221/2 |
| 7,793,836 | B2 * | 9/2010 | Radatti | A61J 3/007 235/375 |
| 9,361,780 | B2 * | 6/2016 | Burke, Jr. | G06F 19/3462 |
| 2005/0151625 | A1 * | 7/2005 | Lai | G08B 21/24 340/309.16 |
| 2006/0181961 | A1 | 8/2006 | Hobkirk | |
| 2006/0187033 | A1 * | 8/2006 | Hall | B65D 7/00 340/539.22 |
| 2006/0256664 | A1 * | 11/2006 | Varon | B65D 79/02 368/89 |
| 2007/0258048 | A1 | 11/2007 | Pitchers | |
| 2009/0096590 | A1 | 4/2009 | Grundelman | |
| 2009/0294521 | A1 * | 12/2009 | de la Huerga | A61J 1/035 235/375 |
| 2010/0039252 | A1 | 2/2010 | Barkus | |

(Continued)

*Primary Examiner* — Anthony D Stashick
*Assistant Examiner* — James M Van Buskirk
(74) *Attorney, Agent, or Firm* — Hovey Williams LLP

(57) ABSTRACT

A container assembly with an expiration date alarm that preserves its battery life by only triggering its alarm when needed. The container assembly includes a container for enclosing a food item, medication, or other product that should not be used after an expiration date; a sensor for sensing when the container has been opened; an alarm; and a timing circuit coupled with the sensor and the alarm for triggering the alarm only if the container is opened after the expiration date has been reached.

10 Claims, 3 Drawing Sheets

(56) References Cited

U.S. PATENT DOCUMENTS

| | | | | |
|---|---|---|---|---|
| 2010/0148958 | A1* | 6/2010 | Chen | G04F 1/005 340/540 |
| 2011/0050415 | A1 | 3/2011 | Fan | |
| 2015/0014318 | A1* | 1/2015 | Taylor | B65D 21/0219 220/321 |

* cited by examiner

CONTAINER WITH EXPIRATION DATE ALARM

STATEMENT REGARDING FEDERALLY-SPONSORED RESEARCH OR DEVELOPMENT

This invention was made with Government support under Contract No.: DE-NA0000622 awarded by the United States Department of Energy/National Nuclear Security Administration. The Government has certain rights in the invention.

BACKGROUND

Many products such as industrial chemicals and compounds, food items, beverages, and medications should not be consumed or used after an expiration date (also often referred to as a "shelf life"). Typically, the expiration date for a product is printed on its container or other packaging. Unfortunately, many people fail to read expiration dates and therefore consume or otherwise use expired products. This can cause health problems, sometimes severe ones, especially when a food or medical product is consumed long after its expiration date. Similarly, use of expired industrial materials or chemical compounds such as adhesives, paints, reagents, etc. can lead to product failures.

Battery-powered shelf-life indicators have been developed to warn of expired products. These shelf-life indicators are typically embedded within or attached to product containers and count-down a time period corresponding to an expiration date. The indicators also display a time period remaining before the expiration date is reached and then provide an alarm or other visual or audible notice when the expiration date has been reached. Although such indicators are effective for products stored in visible or frequently visited places, they are less effective for alerting of expired products stored in warehouses, closets, pantries, cabinets, and other concealed or infrequently visited places because users may not see or hear the alarms before their batteries run-down. After the batteries of such an indicator die, a person may falsely assume the associated product is safe to consume or use because the indicator is no longer providing any indication of the lapsed expiration date.

Accordingly, there is a need for an improved way to alert consumers, industrial workers, and others of products with elapsed expiration dates.

SUMMARY

The present invention solves the above-described problems and provides a distinct advance in the art of shelf-life indicators by providing a container assembly with an expiration date alarm that preserves its battery life by only triggering its alarm when needed. An embodiment of the container assembly includes a container for enclosing or otherwise preventing access to a food item, medication, industrial chemical, industrial compound, or any other product that should not be consumed or used after an expiration date; a sensor for sensing when the container has been opened; an alarm; and a timing circuit coupled with the sensor and the alarm for triggering the alarm only if the container is opened after the expiration date has been reached. By triggering the alarm only if the container is opened after the expiration date has passed, the timing circuit does not unnecessarily trigger the alarm when no one is around. This preserves the battery life of the timing circuit so that the timing circuit can provide an alert of a lapsed expiration date when the product container is ultimately opened.

The container may be any jar, can, vial, package, or other enclosure that holds a product with an expiration date. The container may also be a lashing, strap, or other device that is wrapped around a barrel, box, tub, or other enclosure for a product. In one embodiment, the container has an open-top and a removable lid for covering and substantially sealing the open top. The sensor may be a switch or light sensing device that determines when the lid has been removed from the container. The sensor may alternatively include electrical contacts that form an electrical path between the container and the lid, wherein the electrical path is broken when the lid is removed from the container. The sensor could also be a switch or contacts that determine when a buckle on a lashing or strap is unbuckled, cut, or otherwise removed to gain access to a product.

The alarm may be an audible alarm, a visual alarm, or both. The container assembly may further include a display coupled with the timing circuitry for displaying the expiration date and/or a countdown of the expiration date.

In some embodiments, the timing circuit may include a user interface for permitting a consumer to enter the expiration date, time to expiration, or other date into the timing circuit. In other embodiments, the expiration date may be loaded in the timing circuit by a manufacturer, pharmacist, or other person when the product is first placed in the container.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 3:
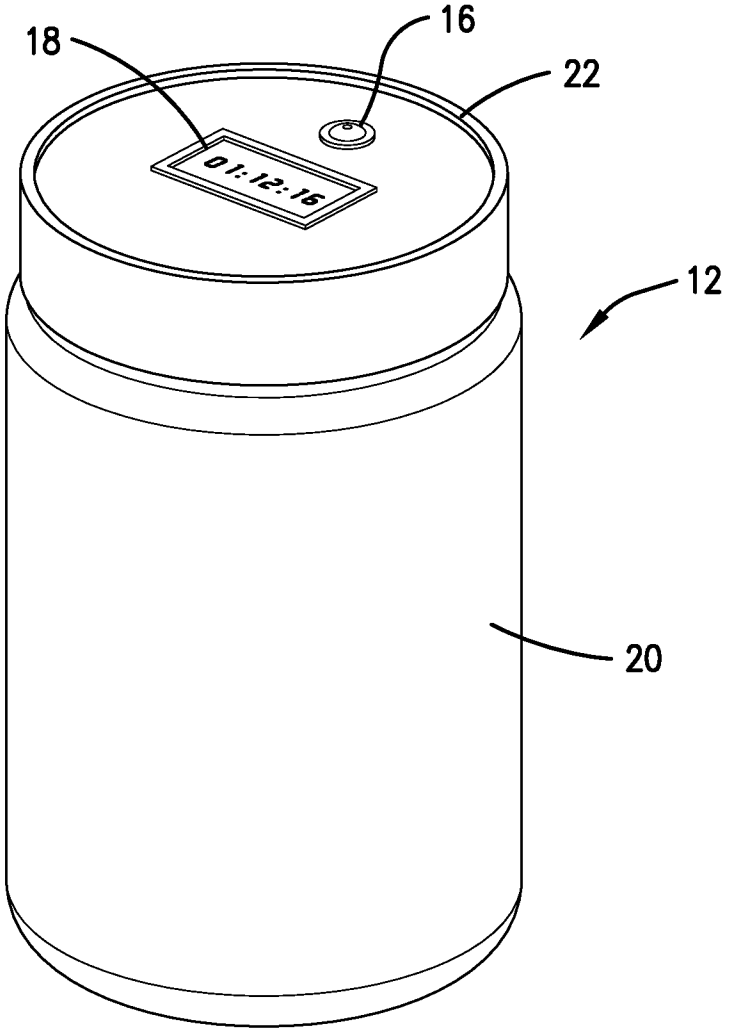

FIG. 3 a perspective view of a container assembly constructed in accordance with an embodiment of the invention.

Figure 4:
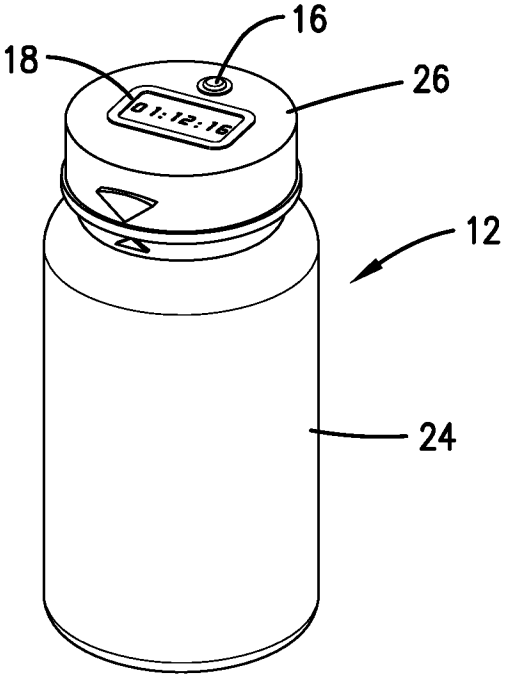

FIG. 4 a perspective view of a container assembly constructed in accordance with another embodiment of the invention.

Figure 5:
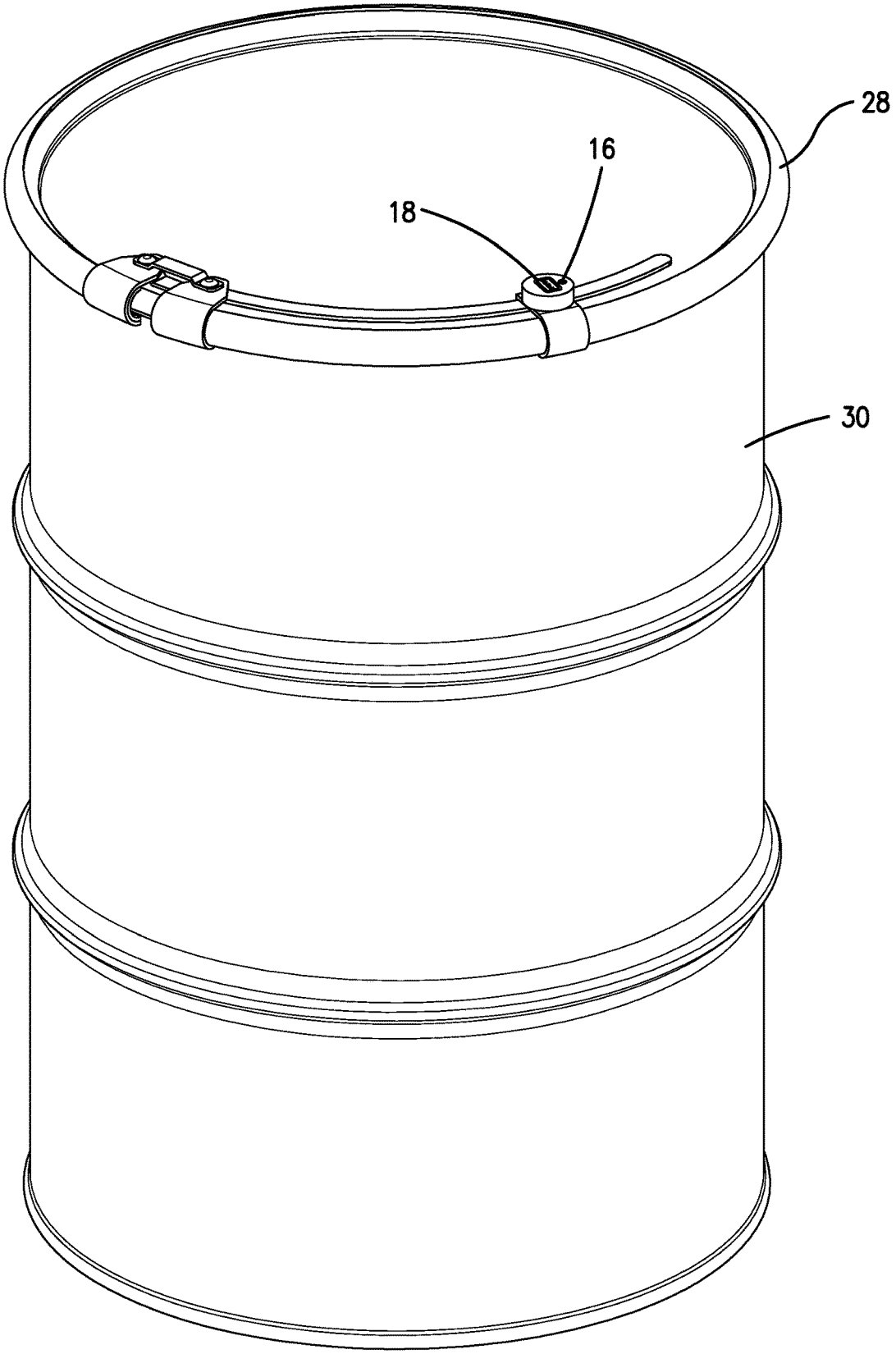

FIG. 5 a perspective view of a container assembly constructed in accordance with another embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 1:
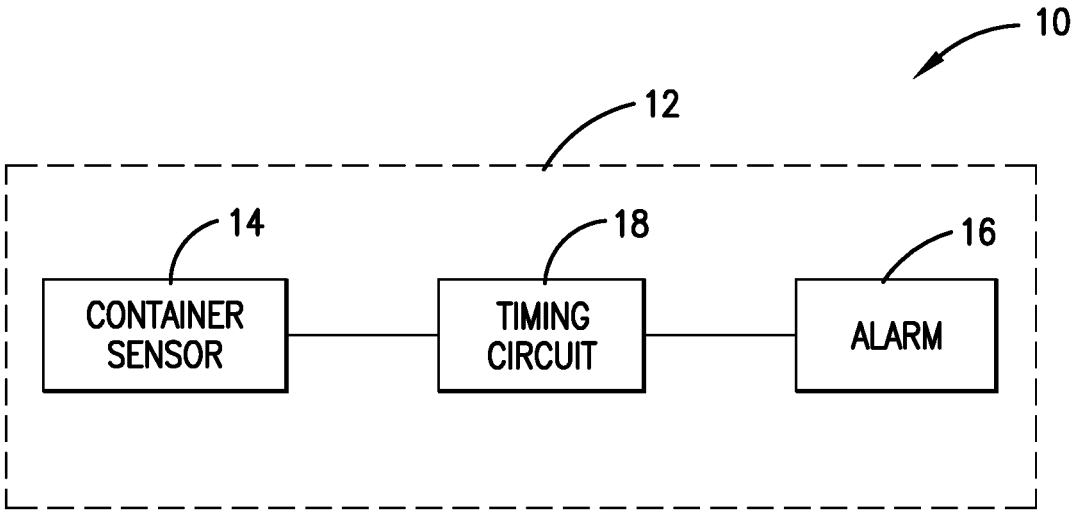
FIG. 1 is a block diagram that depicts selected components of a container assembly constructed in accordance with an embodiment of the invention.

Turning now to the drawing figures, and initially FIG. 1, a container assembly 10 constructed in accordance with an embodiment of the invention is illustrated. The container assembly 10 broadly includes a container 12 for enclosing a food item, medication, or other product that should not be used after an expiration date; a sensor 14 for sensing when the container 12 has been opened; an alarm 16; and a timing circuit 18 coupled with the sensor 14 and the alarm 16 for triggering the alarm. The container assembly also includes power terminals or connectors for connecting to a battery or other power source for powering the alarm 16 and timing circuit 18. Importantly, the timing circuit 18 only triggers the alarm 16 if the container 12 is opened after the expiration date has been reached so as to preserve the life of the battery that powers the timing circuit 18.

The container 12 may be any size and shape and configured to enclose any type or quantity of product. For example, as shown in FIG. 3, one embodiment of the container 12 may be in the form of a jar 20 with a twist-off lid 22. Such a container may store industrial chemicals, compounds, food items, medication ointments, beauty creams, etc. Another embodiment of the container 12 is shown in FIG. 4 and is in the form of a medicine vial 24 with a snap-off lid 26. Such a container may store pills, capsules, or other medicines. In other embodiments, the container 12 may be a sealable bag, tube, sack, box, bottle, can, etc. As shown in FIG. 5, the container may include a lashing, strap, or other device 28 that must be unbuckled, cut, or otherwise removed to access a product in a barrel, box, or other container 30. The container may be designed for one time use or designed to be refilled and reused multiple times.

The sensor 14 may be any device that senses or detects when the container 12 is opened. For example, the sensor 14 may be a switch or light sensor that determines when the lid 22 shown in FIG. 3 or the lid 26 shown in FIG. 4 has been removed from its container. The sensor may also detect when a lashing, strap, or other securement device is unbuckled, cut or otherwise removed to provide access to a product. The sensor 14 may alternatively include electrical contacts that form an electrical path between the container and the timing circuit 18, wherein the electrical path is broken to trip a switch when the lid 22 or lid 26 is removed from its container. The sensor 14 may be configured to only detect when the container 12 is first opened or may detect each time the container is opened. This latter embodiment is useful for containers that store products that are used over time.

The alarm 16 may be any device that can alert a user when triggered by the timing circuit 18. For example, the alarm 16 may be an audible alarm such as a beeper, bell, or speaker; a visual alarm such as an LED light; or a combination audible/visual alarm. In some embodiments of the invention, the alarm 16 may include a wireless transmitter configured to transmit an alert from the timing circuit 18 to a remote device such as a computer, tablet, smart phone, or the like.

The timing circuit 18 may comprise any number or combination of processors, circuits, integrated circuits, programmable logic devices, programmable logic controllers (PLCs), or motion programmable logic controllers (MPLCs), computers, processors, microcontrollers, transmitters, receivers, other electrical and computing devices, and/or residential or external memory for storing data and other information. The timing circuit 18 may store one or more expiration dates and is operable to count-down the expiration dates or otherwise determine when they have expired. The timing circuit 18 also monitors the state of the sensor 14 and triggers the alarm 16 only if the container 12 is opened after an expiration date for a product stored in the container 12 has expired. When the sensor 14 and timing circuit 18 sense that the container 12 has been opened before the expiration date, the timing circuit 18 does not trigger the alarm 16.

The timing circuit 18 may be configured to implement any combination of algorithms, subroutines, computer programs, or code segments corresponding to method steps and functions described herein. The timing circuit and computer programs described herein are merely examples of circuitry and programs that may be used to implement the present invention and may be replaced with or supplemented with other devices and/or programs without departing from the scope of the present invention. While certain features of the invention are described as residing or performed by in the timing circuit 18, the invention is not so limited, and those features may be implemented elsewhere.

Computer programs or code segments implemented by the timing circuit 18 may comprise ordered listings of executable instructions for implementing logical functions in the timing circuit. The computer programs can be embodied in any computer-readable medium for use by or in connection with any instruction execution system, apparatus, or device. In the context of this application, a "computer-readable medium" can be any physical medium that can contain, store, communicate, propagate, or transport the program for use by or in connection with the instruction execution system, apparatus, or device. The computer-readable medium can be, for example, but not limited to, an electronic, magnetic, optical, electro-magnetic, infrared, or semi-conductor system, apparatus, or device. More specific, although not inclusive, examples of the computer-readable medium include the following: an electrical connection having one or more wires, a portable computer diskette, a random access memory (RAM), a read-only memory (ROM), an erasable, programmable, read-only memory (EPROM or Flash memory), a portable compact disk read-only memory (CDROM), an optical fiber, multi-media card (MMC), reduced-size multi-media card (RS MMC), secure digital (SD) cards such as microSD or miniSD, and a subscriber identity module (SIM) card.

Figure 2:
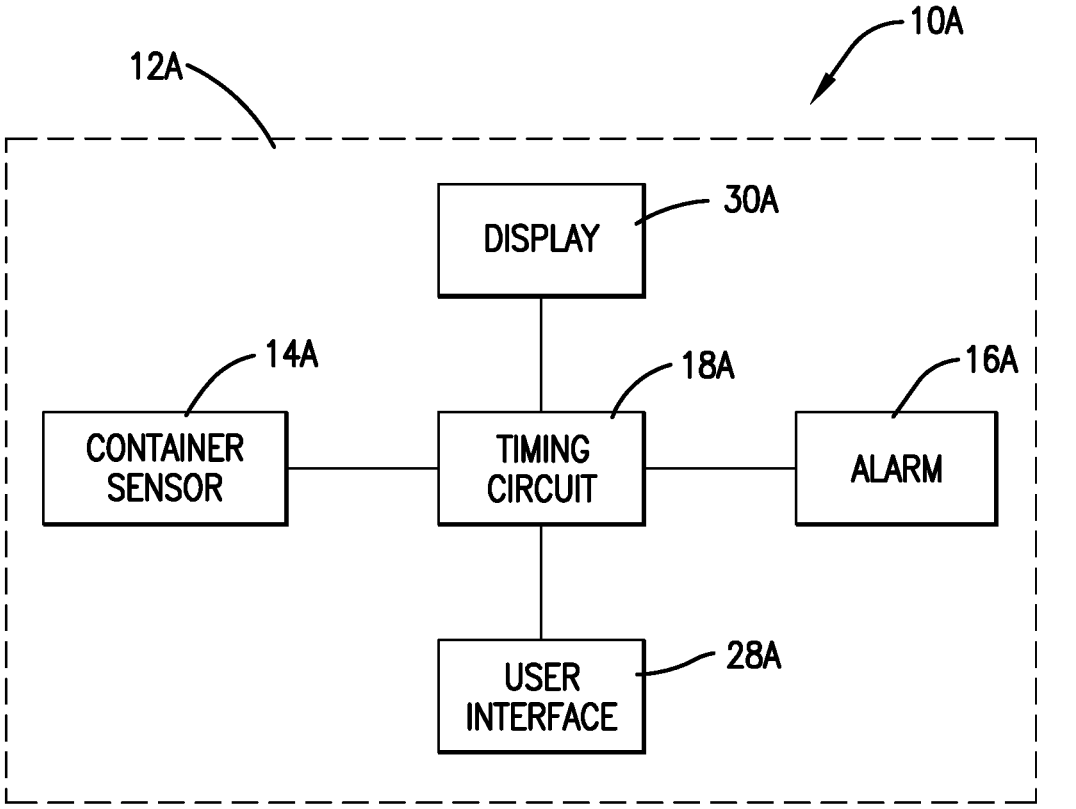
FIG. 2 is a block diagram that depicts selected components of a container assembly constructed in accordance with another embodiment of the invention.

FIG. 2 illustrates a container assembly 10A constructed in accordance with another embodiment of the invention. As with the container assembly 10 described above, the container assembly 10A broadly includes a container 12A for enclosing industrial chemicals, industrial compounds, food items, medications, or other substances that should not be used after an expiration date; a sensor 14A for sensing when the container 12 has been opened; an alarm 16A; and a timing circuit 18A coupled with the sensor 14A and the alarm 16A for triggering the alarm. The container 12A, sensor 14A, alarm 16A, and timing circuit 18A are substantially identical to the like-numbered components described above. In this second embodiment, the container assembly 10A also includes a user interface 28A for permitting a user to enter the expiration date or a time period into the timing circuit 18A. The user interface may be a touchscreen display, one or more buttons, or any other mechanism for entering data into the timing circuit. The container assembly 10A may further include a display 30A coupled with the timing circuit 18A for displaying the expiration date and a time period remaining before the expiration date is reached. In come embodiments, the user interface 28A and display 30A are a single device.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

The invention claimed is:

1. A container assembly comprising:

a container for enclosing a product that should not be used after an expiration date;

a strap that completely encircles an upper rim of the container and that must be removed to access the product inside the container;

a sensor for sensing when the strap is removed from the container, the sensor including electrical contacts that form an electrical path between the container and the strap, wherein the electrical path is broken when the strap is removed from the container;

an alarm comprising a transmitter configured to transmit an alarm notice to a remote device; and a timing circuit mounted on the strap and coupled with the sensor and the alarm for monitoring a time period associated with the expiration date and triggering the alarm only if the strap is removed after the time period, the timing circuit including a user interface having at least one of a touchscreen, button, and mechanism for permitting a user to enter the expiration date into the timing circuit, wherein the timing circuit is configured to transmit an alert to the alarm which then transmits the alarm notice to the remote device only when the strap is removed after the time period.

2. The container assembly as set forth in claim 1, wherein the container has an open top and a removable lid for covering and substantially sealing the open top.

3. The container assembly as set forth in claim 1, wherein the alarm is an audible alarm or a visual alarm.

4. The container assembly as set forth in claim 1, further comprising a display coupled with the timing circuit for displaying the expiration date and a time period remaining before the expiration date is reached.

5. A container assembly comprising:

an open-topped container for enclosing a product that should not be used after an expiration date;

a lid for closing the open-topped container;

a strap that completely encircles an upper rim of the container and an upper rim of the lid so that the strap must be removed to access the product inside the container;

a sensor for sensing when the strap is removed from the container, the sensor including electrical contacts that form an electrical path between the container and the strap, wherein the electrical path is broken when the strap is removed from the container;

an alarm comprising a transmitter configured to transmit an alarm notice to a remote device; and a timing circuit mounted on the strap and coupled with the sensor and the alarm for monitoring the expiration date and triggering the alarm only when the strap is removed from the container after the expiration date, the timing circuit including a user interface having at least one of a touchscreen, button, and mechanism for permitting a user to enter the expiration date into the timing circuit, wherein the timing circuit is configured to transmit an alert to the alarm which then transmits the alarm notice to the remote device only when the strap is removed after the time period.

6. The container assembly as set forth in claim 5, wherein the alarm is an audible alarm.

7. The container assembly as set forth in claim 5, wherein the alarm is a visual alarm.

8. The container assembly as set forth in claim 5, further comprising a display coupled with the timing circuit for displaying the expiration date and a time period remaining before the expiration date is reached.

9. The container assembly as set forth in claim 5, wherein the alarm is mounted on or in the strap.

10. A container assembly comprising:

an open-topped container for enclosing a product that should not be used after an expiration date;

a lid for closing the open-topped container;

a strap that completely encircles an upper rim of the container and an upper rim of the lid so that the strap must be removed to access the product inside the container;

a sensor for sensing when the strap is removed from the container, the sensor having electrical contacts;

an alarm comprising a transmitter configured to transmit an alarm notice to a remote device;

a timing circuit coupled with the sensor and the alarm, the electrical contacts forming an electrical path between the container and the timing circuit, wherein the electrical path is broken when the strap is removed from the container, the timing circuit including— a user interface having at least one of a touchscreen, button, and mechanism for entering the expiration date, memory for storing data representative of the expiration date, and circuitry that determines when the expiration date has been reached and does not trigger the alarm if the expiration date has not been reached and the strap is not removed;

does not trigger the alarm if the expiration date has been reached and the strap is not removed;

does not trigger the alarm if the expiration date has not been reached and the strap is removed; and that triggers the alarm only when the strap is removed from the container after the expiration date has been reached; and a display coupled with the timing circuitry for displaying the expiration date and a time period remaining before the expiration date is reached, wherein the timing circuit is configured to transmit an alert to the alarm which then transmits the alarm notice to the remote device only when the strap is removed after the time period.

* * * * *